United States Patent [19]

Maddock

[11] Patent Number: 4,789,570

[45] Date of Patent: Dec. 6, 1988

[54] ARTIFICIAL SHRUB

[75] Inventor: William H. Maddock, Markham, Canada

[73] Assignee: Noma Inc., Scarborough, Canada

[21] Appl. No.: 857,229

[22] Filed: Apr. 29, 1986

[51] Int. Cl.[4] ..... A47G 33/06

[52] U.S. Cl. ..... 428/8; 211/205; 428/20

[58] Field of Search ..... 428/8, 18, 19, 20, 17, 428/9; D11/118; 211/196, 205; 362/123; 156/61

[56] References Cited

U.S. PATENT DOCUMENTS

| | | | |
|---|---|---|---|
| 3,179,070 | 4/1965 | Beller | 428/18 X |
| 3,674,612 | 7/1972 | Gehl, Jr. | 428/7 |
| 3,679,528 | 7/1972 | Spiegel | 428/7 |
| 3,746,601 | 7/1973 | Strony | 428/18 |
| 4,273,814 | 6/1981 | Koehler | 428/20 X |
| 4,291,075 | 9/1981 | Puleo | 428/20 X |
| 4,343,842 | 8/1982 | Chase | 428/20 X |
| 4,451,510 | 5/1984 | Boisvert et al. | 428/20 X |

FOREIGN PATENT DOCUMENTS

| | | | |
|---|---|---|---|
| 2169198 | 7/1986 | United Kingdom | 428/9 |

*Primary Examiner*—Henry F. Epstein
*Attorney, Agent, or Firm*—Kenneth M. Garrett

[57] ABSTRACT

An artificial shrub or the like including at least one branch holder; said branch holder including a hub; a plurality of adjacent equispaced, radial walls supported from said hub; each said radial wall having a transverse aperture communicating with each lateral side thereof; a plurality of branches, each said branch having a u shaped hooked end thereto, said hooked ends being captured in said transverse apertures to thereby form hinge elements for said branches whereby said branches can be moved between a generally upstanding, stored position and an outspread position; means interconnected with said hub for supporting said branches in said outspread position.

17 Claims, 2 Drawing Sheets

ARTIFICIAL SHRUB

FIELD OF INVENTION

This invention relates to artificial shrubs, particularly those which are mass merchandized for Christmas decorations, although it is not necessarily limited thereto.

BACKGROUND OF INVENTION

Artificial shrubs of the foregoing type generally fall into two categories. In those of the first category, individual branches, which may number 50 or more depending upon the nature of the shrub and its height, are required to be inserted into openings in the trunk of the shrub or holders supported from the trunk each time the shrub is erected, and then withdrawn for storage of the shrub. Since the branch lengths vary so as to give a realistic, tapered appearance to the shrub, the assembly process defeats a less competent segment of society. Even for the more competent segment, the assembly can be tedious and time consuming. The category of artificial shrub aims to overcome these problems by providing partially preassembled shrubs wherein the branches are permanently secured to branch holders, which holders may be supported on a central support pole or keyed together, for example. For storage purposes the securement means is such as to permit the branches to pivot between an upstanding stored position and an outspread position.

Many proposals have been heretofore made of record for pivotally connecting the branches. In one such proposal, the construction necessitated drilling and rivetting, making the second construction somewhat less competetive economically with the first type. In a second embodiment of the pivotable structure a pivot is molded as a spur into the branch support structure, and a loop formed at the end of a branch is engageable therewith. The loop is maintained in engagement with the pivot by using a separately provided wedge. This structure is amenable to user assembly, but in practise it has been found to be disadvantageous in permitting an undesirable lateral movement (wobbling) of the branches, and in necessitating the provision of a separate component which can be misplaced.

The problem of providing a pivoting type branch holder which did not require the provision of additional parts, and yet which gave a firm support to the branch was addressed by Koehler, U.S. Pat. No. 4,273,814 commonly assigned herewith. In accordance with this proposal the branch holder comprised pairs of axially aligned, spaced apart walls, one of the walls having a transverse opening thereto and a passageway communicating with the opening. The end of the stem of the branch was turned at right angles whereby the end could be inserted through the passageway into the opening, which formed a bearing for the branch, while the portion of the stem location outwardly of the turned end was firmly supported in its outspaced portion between the opposed walls. While this solution is suitable for shrubs of a certain appearance, the double wall structure of the branch holder tends to limit the number of branches that can be secured to the trunk at a particular level to about 6, whereas it is sometimes desirable in order to provide a layered appearance that this be increased to about 12.

SUMMARY OF THE INVENTION

It is then an object of this invention to provide improvements to artificial shrubs.

It is another object of this invention to provide improved branch holders for shrubs.

It is another object to provide artificial shrubs of economic cost, and reliable performance which may have a pleasing aesthetic appearance.

It is yet another object of my invention to provide artificial shrubs which facilitate the connection of the branches to the holders, whether this is performed in a factory operation or by a user.

In accordance with one aspect of the invention, an artificial shrub comprises a trunk having a plurality of branch holders axially spaced therealong. Such branch holder comprises a hub, which may be integrated with the trunk or separately supported therefrom when the tree is assembled, and a disk-like flange radiating from the hub. The flange has a plurality of radial walls upstanding therefrom, at least some of the walls being provided with a transverse aperture therethrough defining a bearing for a pivot element of a branch, and in which the pivot element is receivable and rotatable to permit the branch to swing in the axial plane of the trunk between a stored, upright position and a outspread position wherein it is supported by the flange. A passageway connects the bearing aperture to a free edge of the radial wall which is generally remote from the outwardly facing end thereof, to permit the introduction of the pivot element into the bearing opening. The inscribed circular dimension of the passageway adjacent the juncture of the passageway and the bearing opening is marginally less than the inscribed circular dimension of the bearing opening, thereby forming a trap to retain the pivot element in the bearing opening.

The stem of the branch is hooked, preferably by folding the end of the stem over into a U shape, with the bight of the hook forming the pivot element. The transverse spacing between the arms of the hook is preferably such that the arms provide an interference fit and grasp the radial wall, so as to resist lateral movement of the branch and rotational movement about the axis of the stem.

In accordance with more specific aspects of the passageway communicates with the free edge of the radial wall at the inwardly facing end thereof which, in the vicinity of the opening to the passageway, is spaced apart from the hub. Desirably, the upper surface of the flagne defines the lower margin of the passageway and bearing opening, and is slotted to be in communication therewith, so as to facilitate the moulding of the holder as a unitary structure without the use of mould inserts.

In accordance with still further aspects of the invention, the holder includes a plurality of radial walls cantilevered outwardly from the central support element and connected to the flange on the underside thereof.

Preferably, the central support element is tubular, and includes means for indexing a branch holder in relation to an adjacent branch holder.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 2:
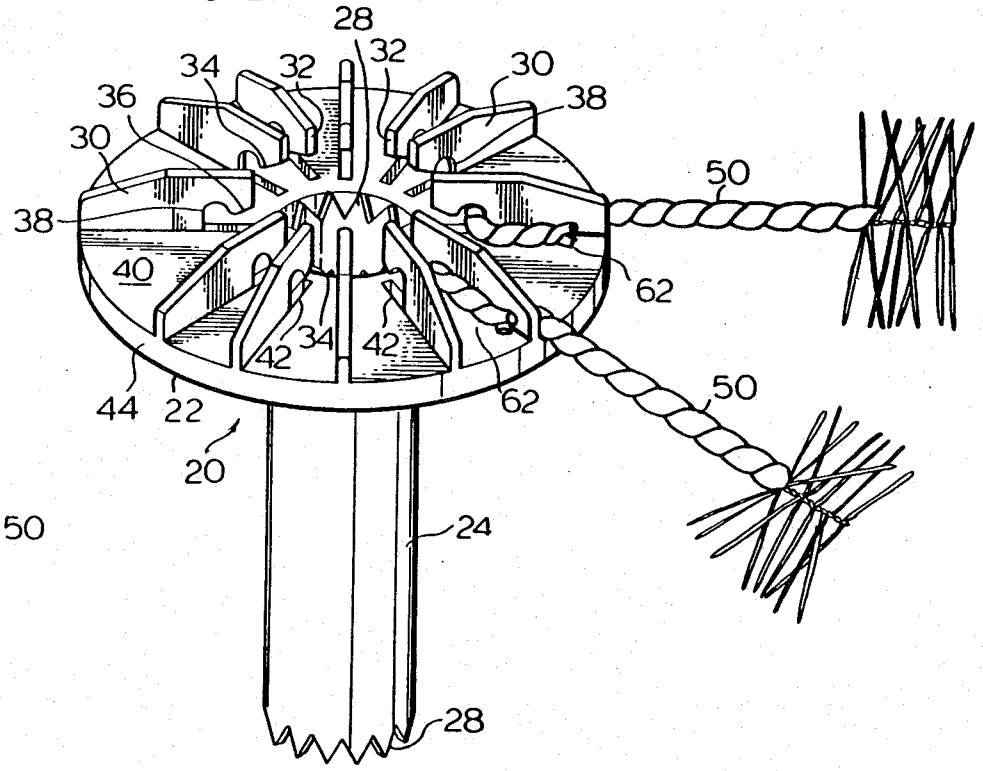
FIG. 2 shows in perspective view from above a branch holder in accordance with the invention, to which holder the stems of two branches are shown in assembled relationship.
Figure 1:
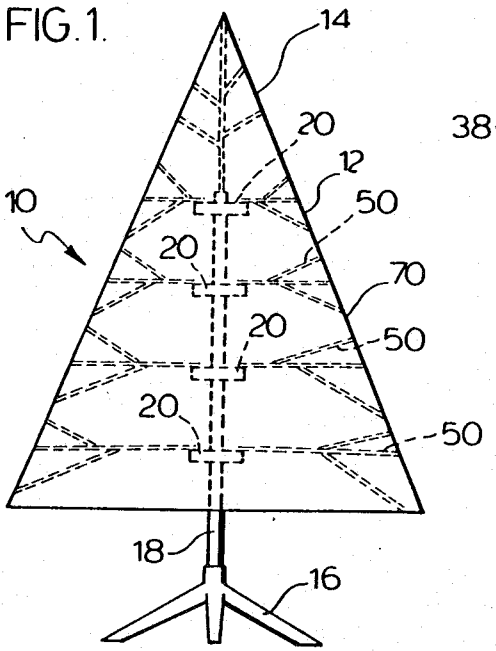
FIG. 1 shows a schematic perspecive view of an artificial tree as contemplated by the invention.
Figure 4:
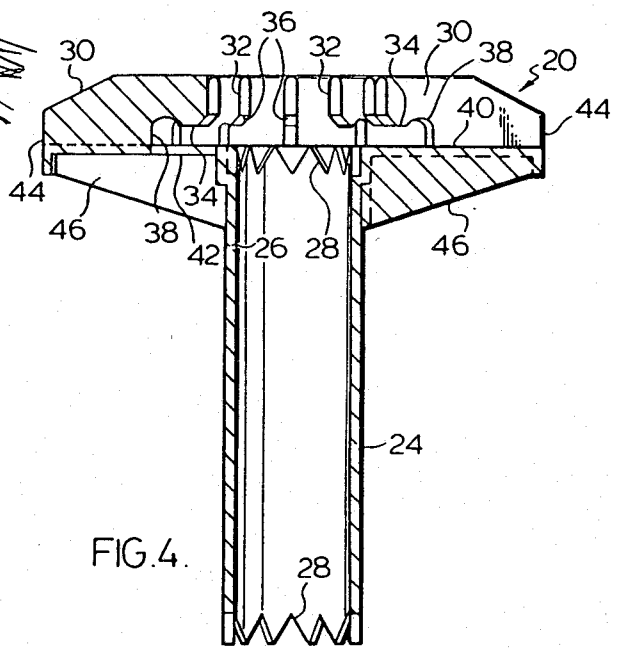
FIG. 4 is a sectional view on line 4—4 of FIG. 3 in the direction of the arrows.

With reference to the drawings an artificial shrub is denoted therein by the numeral 10 and comprises a main portion 12 and top portion 14 supported from a base 16. A support pole 18 is upstanding from base 16; conveniently, and as known in the art, support pole 18 may be formed from a limited number of members the ends of which telescope one into the other so as to form a relatively rigid structure. A plurality of branch holders 20 are slidingly received on support pole 18. Branch holders 20 comprise a platform 22 in the form of a disk like flange. A plurality of the branch holders are axially maintained in spaced apart relationship on pole 18 by means of tubular spacers 24 which are slidingly received on the pole. Conveniently spacers 24 are integrally formed with branch holders 20 and form part of a hub 26 from which the platform 22 radiates. The upper and lower extremities of tubular spacers 24 are formed with saw toothed notches 28 which permit the branch holders 20 to be stacked in a indexed relationship on pole 18.

Arranged in equi-spaced relationship on platform 22 are a number of radially aligned, vertically upstanding walls 30. Radial walls 30 have an inwardly facing free edge 32, and are provided with a radially extending passageway 34 which communicates with the free edge. The upper surface of the entrance to passageway 34 is downwardly inclined at 36 to form a ramp surface. The blind end of passageway 34 is enlarged somewhat at 38. The lower margin of passageway 34 is defined by the upper surface 40 of platform 22. The platform is slotted at 42 in communication with the passageway, to permit the moulding of the undercut surfaces of passageway 34 using a simple two part mould. The outer peripheral edge 44 of platform 22 is downwardly turned to stiffen the platform; further stiffening is provided by radially aligned walls 46 cantilevered outwardly from hub 26 which connect to the underside of platform 22. Suitably, branch holders 20 are moulded from a thermoplastic resinous material.

Branches 50 of the main portion 12 of shrub 10 are formed of relatively heavy gauge wire, with two strands being twisted together to trap flat filaments 52 therebetween in a manner well known in the art. The stem portion 54 of the branches 50 is devoid of filaments 52. The end portion 56 of the stem portion 54 is turned twice at right angles to form a U shaped hook 58. Hook 58 is formed in part by stem 54, a bight 60 and a tip 62, the tip being parallel to stem portion and spaced apart therefrom by the thickness of wall 30.

Figure 3:
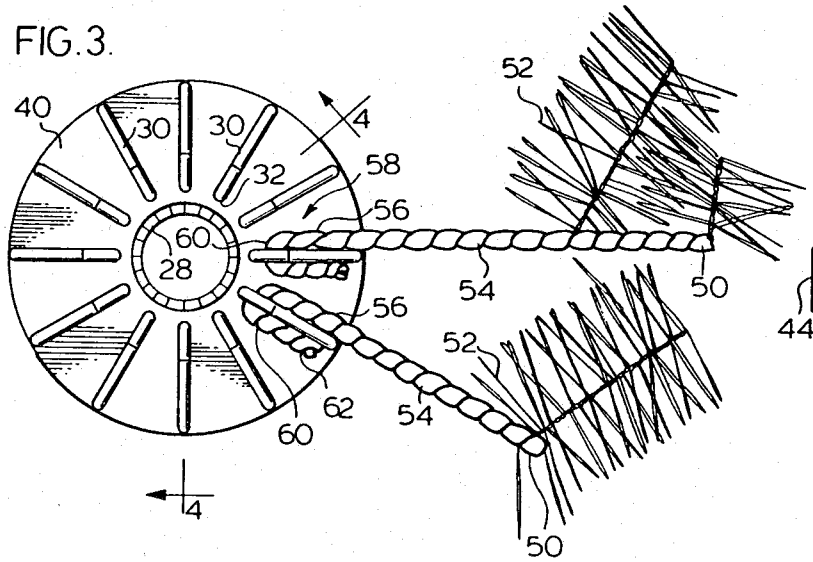
FIG. 3 shows the branch holder of FIG. 2 in plan view.

The assembly of branches 50 to branch holders 20 is initiated by engaging the bight 60 of hook 58 in the entrance to passageway 34, and then exerting a tensile force on branch 50 to urge it outwardly relative to the branch holder. The circumcircular cross sectional dimension of bight 60 is marginally greater than the inscribed circular dimension of passageway 34, at least at the juncture of the passageway with the blind end 38. The tensile force applied to branch 50 acts to deform wall 30 elastically whereby the bight of the hook 58 becomes trapped in blind end 38. The blind end 38 thereby forms a bearing for bight 60 about which branch 50 may be pivoted between a generally upright position, for storage, and a outspread position as illustrated in FIGS. 2 and 3. In its outspread position, the hooked end of branch 50 firmly grips and interferes with wall 30 and lays along the upper surface 40 of platform 22. The contact area between the platform surface 40 and branch 50 is maximized by ensuring that the blind end 38 forming the bearing for the branch locates radially well inwardly of the peripheral edge of the platform. For this purpose the upper edge of hub 26 and the notched indexing means 28 thereon does not project above the level of the upper surface 40 of platform 22, so as not to impede the entry of hooked ends 58 of branches 50 into the passageways 34. The branches 50 secured to different axially spaced branch holders 20 may differ somewhat in their length and density of furnish or other characteristic as is commonly known in the art, so as to provide the main portion 12 of shrub 10 with a realistic appearance. The outer ends of the branches of the assembled tree will normally reside approximately on a frustrated conical surface 70. The top portion of shrub 10 is normally preassembled from twisted wire in a construction similar to that of branches 50, the stem of the top portion commonly being received in an axial bore in pole 18 to complete the artificial shrub.

It will be apparent from the foregoing description that many changes may be made to the illustrated embodiment both for structural and aesthetic reasons, which achieving at least action of the aims, objects and advantages of the invention. It is intended that all such variations fall within the spirit of the claims appended hereto be encompassed by the invention.

I claim:

1. In an artificial shrub comprising a plurality of spaced apart branch holders and a plurality of branches supported thereby, the improvement wherein a said branch holder comprises:

a hub;

a disk-like flange radiating outwardly from said hub, and a plurality of adjacent equi-spaced radial walls upstanding from said flange, each said wall having a transverse aperture therethough to form a bearing, and a passageway connecting said bearing aperture to a free edge of said radial wall to provide an entrance to said passageway, said passageway having an inscribed circular dimension adjacent the juncture thereof with said bearing aperture less than that of said bearing aperture to form a trap; and wherein a said branch is hooked at the inward end thereof to form a stem portion, a bight portion and an outwardly directed tip portion; said bight portion being outwardly movable from the entrance to said passageway therealong to be captured in said bearing aperture by said trap, whereby said bight portion is rotatable in said bearing aperture to permit said branch to move between an upright, stored position and an outstretched position, and where in said outstretched position, said stem portion and said tip portion are in proximity to opposed sides of a radial wall and to said flange, thereby reducing the degree of undesired movement of said branch when in said outstretched position.

2. A shrub as defined in claim 1, wherein said free edge of said radial wall is radially opposed to said hub.

3. A shrub as defined in claim 2, wherein said flange is provided with a slotted opening communicating with said bearing aperture.

4. A shrub as defined in claim 2, wherein said flange is provided with a slotted opening communicating with said bearing aperture and said passageway and the upper surface of said flange defines the lower margin of said bearing aperture.

5. A shrub as defined in claim 1, further comprising a plurality of radial walls cantilevered outwardly from said hub and connecting to said flange on the underside thereof.

6. A shrub as defined in claim 1, wherein said hub is tubular and is elongated to form a spacer and wherein the axial ends thereof of said hub are provided with indexing means.

7. A shrub as defined in claim 6, wherein the upper surface of said flange adjacent said hub locates generally above the level of the upper of the indexing means.

8. A shrub as defined in claim 6, wherein the hub extends downwardly below said flange to form a spacer.

9. In combination, a holder for a branch of an artificial shrub comprising:

a circular, axially elongated wall;

a disk-like flange radiating outwardly from said axial wall and integral therewith;

a plurality of adjacent equi-spaced radial walls upstanding from said flange, the inwardly facing ends of said radial walls residing on a circular locus outwardly spaced from the circular wall, each said radial walls having an elongated opening therein communicating with the inwardly facing end of said radial wall, said opening being enlarged at the blind end thereof so as to form a bearing for a said branch to permit said branch to be rotated between a stored position generally axially aligned and an outspread position wherein it is supported from said flange, said branch having an inwardly facing end thereof hooked to form a bight, said bight being engaged in a said bearing to permit said branch to be swung between an upstanding, stored position and an outstretched position, in which said hooked end of said branch interfaces with said radial wall associated with said bearing on each radial side thereof to reduce the degree of undesired movement of said branch.

10. A combination as defined in claim 9, wherein said elongated opening is defined along its lowest extremity by said flange.

11. A combination as defined in claim 9, wherein said flange is slotted along the length of said elongated opening in communication therewith.

12. A combination as defined in claim 9, wherein the height of said elongated opening decreases from adjacent the entrance to said opening towards said blind end.

13. A combination as defined in claim 9, wherein said branch holder is formed as a unitary molding from a thermoplastic material.

14. An artificial shrub including:

an axially elongated trunk;

a plurality of disks axially spaced apart and radiating therefrom;

each said disk including a plurality of adjacent equi-spaced radial walls upstanding therefrom, each said radial wall having a free inwardly facing end portion with a passageway communicating with the inwardly facing end portion, intermediate portions of said passageway having a reduced inscribed circular dimension in comparison to the blind end of said passageway to form a trap; and a plurality of branches each having a U shaped hooked end, the bight of said hooked end being trapped in said blind end of said passageway whereby said branches are rotatable between a stored, upstanding position and an outstretched position wherein end portions of each said branches are supported from the surface of the disk associated therewith, wherein portions of said hooked end interfere with said radial wall associated therewith so as to resist rotational movement about the major axis of said branch.

15. In combination, a branch holder for an artificial shrub comprising:

a hub;

a disk-like flange radiating outwardly from said hub;

a plurality of radial walls upstanding from said flange;

at least adjacent ones of said radial walls being provided with a transverse aperture therethrough defining a bearing for a pivot element of said branch and in which said pivot element is receivable and rotatable to permit swinging of the branch in said bearing between a stored position wherein it is generally aligned with the axis of said hub and an outspread position wherein it is supported from the flange;

a passageway connecting said bearing aperture to a free edge of said radial wall generally remote from the outwardly facing end thereof to permit the introduction of said pivot element into said bearing opening, said passageway being constricted adjacent the juncture thereof with said bearing aperture to form a trap for said pivot element and a branch having a hooked end including a bight portion defining said pivot element, portions of said hooked end interfering with said radial wall associated with said pivot element when said branch is rotated to its outspread position to reduce the degree of undesired movement of said branch.

16. An artificial shrub including:

at least one branch holder;

said holder including:

a hub;

a plurality of adjacent equi-spaced radial walls supported from said hub;

each said radial wall having a transverse aperture communicating with each lateral side thereof;

a plurality of branches, each said branch having a hooked end thereto, said hooked ends being captured in said transverse apertures to thereby form a hinge element for said branches whereby said branches can be moved between a generally upstanding, stored position and an outspread position in which said hooked ends grip said radial walls; and flange means interconnected with said radial walls for supporting said branches in said outspread position.

17. An artificial shrub comprising:

and axially elongated trunk;

a plurality of branch holders supported on said trunk;

each said branch holder comprising a hub;

a disk-like flange radiating outwardly from said hub;

a plurality of adjacent radial walls upstanding from said flange;

each said radial wall having a passageway extending to a free edge thereof, and terminating in a blind end;

a branch having a U shaped end with the bight thereof engaged in said passageway adjacent said blind end, and means trapping said bight in said passageway.

* * * * *